US010804640B2

(12) United States Patent
Zhao

(10) Patent No.: US 10,804,640 B2
(45) Date of Patent: Oct. 13, 2020

(54) ELECTRICAL CONNECTOR EQUIPPED WITH DUAL SHELLS

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Jun Zhao, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/254,615

(22) Filed: Jan. 23, 2019

(65) Prior Publication Data

US 2019/0229456 A1 Jul. 25, 2019

(30) Foreign Application Priority Data

Jan. 23, 2018 (CN) ..... 2018 1 0061720

(51) Int. Cl.
*H01R 13/504* (2006.01)
*H01R 13/6581* (2011.01)
(Continued)

(52) U.S. Cl.
CPC ..... *H01R 13/504* (2013.01); *H01R 13/6581* (2013.01); *H01R 13/6595* (2013.01);
(Continued)

(58) Field of Classification Search
CPC .. H01R 13/6594; H01R 12/724; H01R 24/60; H01R 13/6581; H01R 13/6585;
(Continued)

(56) References Cited

U.S. PATENT DOCUMENTS 6,986,681 B2 * 1/2006 Tsai ..... H01R 12/716 439/607.36
8,882,515 B2 * 11/2014 Lv ..... H01R 13/6581 439/79
8,882,542 B2 * 11/2014 Song ..... H01R 12/707 439/607.4
9,088,108 B2 * 7/2015 Zhao ..... H01R 13/6581
(Continued)

FOREIGN PATENT DOCUMENTS

CN 203859323 U 10/2014
CN 204732590 U 10/2015

*Primary Examiner* — Edwin A. Leon
*Assistant Examiner* — Matthew T Dzierzynski
(74) *Attorney, Agent, or Firm* — Wei Te Chung; Ming Chieh Chang

(57) ABSTRACT

The electrical connector includes an insulative housing enclosed within a metallic shell unit and retaining a plurality of contacts therein. The housing includes a base and a tongue extending forwardly from the base. Each contact has a contacting section exposed upon the tongue and a leg located outside the housing. The shell unit includes an inner shell attached to the housing, and an outer shell secured to the inner shell and forming a pair of rear mounting legs. The housing forms a rear fixing block holding the pair of mounting legs in position for alignment with corresponding holes in the printed circuit board to which the legs of the contacts are soldered.

16 Claims, 6 Drawing Sheets

(51) Int. Cl.

| | |
|---|---|
| ***H01R 13/6595*** | (2011.01) |
| ***H01R 12/55*** | (2011.01) |
| ***H01R 107/00*** | (2006.01) |
| ***H01R 24/60*** | (2011.01) |
| ***H01R 12/72*** | (2011.01) |

(52) U.S. Cl.
CPC ..... *H01R 12/55* (2013.01); *H01R 12/724* (2013.01); *H01R 24/60* (2013.01); *H01R 2107/00* (2013.01)

(58) Field of Classification Search
CPC ..... H01R 13/5219; H01R 2107/00; H01R 12/707; H01R 13/6471; H01R 13/405; H01R 13/5202; H01R 13/6582; H01R 13/6586
See application file for complete search history.

(56) References Cited

U.S. PATENT DOCUMENTS

| | | | | |
|---|---|---|---|---|
| 9,093,797 | B2 * | 7/2015 | Zhao | H01R 12/707 |
| 9,112,296 | B2 * | 8/2015 | Zhang | H01R 13/516 |
| 9,136,623 | B2 * | 9/2015 | Hamada | H01R 12/71 |
| 9,385,484 | B2 * | 7/2016 | Chen | H01R 13/6594 |
| 9,391,391 | B2 * | 7/2016 | Chien | H01R 13/5202 |
| 9,478,915 | B2 * | 10/2016 | Guo | H01R 13/6585 |
| 9,484,679 | B2 * | 11/2016 | Guo | H01R 13/6585 |
| 9,496,654 | B2 * | 11/2016 | Little | H01R 13/6583 |
| 9,531,134 | B2 * | 12/2016 | Peng | H01R 13/6585 |
| 9,553,410 | B2 * | 1/2017 | Zhao | H01R 13/6581 |
| 9,590,353 | B2 * | 3/2017 | Regnier | H01R 24/62 |
| 9,742,098 | B2 * | 8/2017 | Zhao | H01R 13/5202 |
| 9,742,125 | B2 * | 8/2017 | Zhao | H01R 13/6594 |
| 9,843,148 | B2 * | 12/2017 | Little | H01R 24/60 |
| 2016/0149349 | A1 * | 5/2016 | Kao | H01R 13/6586 439/607.05 |

* cited by examiner

ELECTRICAL CONNECTOR EQUIPPED WITH DUAL SHELLS

BACKGROUND OF THE INVENTION

1. Field of the Invention

The present invention relates generally to an electrical connector, and more particularly to the electrical connector equipped with a pair of metallic shells having no deformation thereof.

2. Description of Related Arts

U.S. Pat. No. 9,496,654 discloses an electrical connector having a metallic shell enclosing the insulative housing with a pair of rear mounting legs for mounting to a printed circuit board on which the connector is seated. Because the pair of rear mounting legs essentially extend away from the housing in a suspended manner, those mounting legs tend to be tilted or distorted, thus failing to be correctly positioned upon or inserted into the corresponding holes in the printed circuit board disadvantageously.

An improved the electrical connector with the corrected positioned mounting legs of the metallic outer shell is desired.

SUMMARY OF THE INVENTION

An object of the present invention is to provide an electrical connector with reliable mounting legs of the metallic outer shell. The electrical connector includes an insulative housing enclosed within a metallic shell unit and retaining a plurality of contacts therein. The housing includes a base and a tongue extending forwardly from the base. Each contact has a contacting section exposed upon the tongue and a leg located outside the housing. The shell unit includes an inner shell attached to the housing, and an outer shell secured to the inner shell and forming a pair of rear mounting legs. The housing forms a rear fixing block holding the pair of mounting legs in position for alignment with corresponding holes in the printed circuit board to which the legs of the contacts are soldered.

Notably, with assistance of the fixing block, the rear mounting legs of the shell unit may be reliably retained in the correct positions with regard to the printed circuit board.

DETAILED DESCRIPTION OF THE PREFERRED EMBODIMENT

Figure 1:
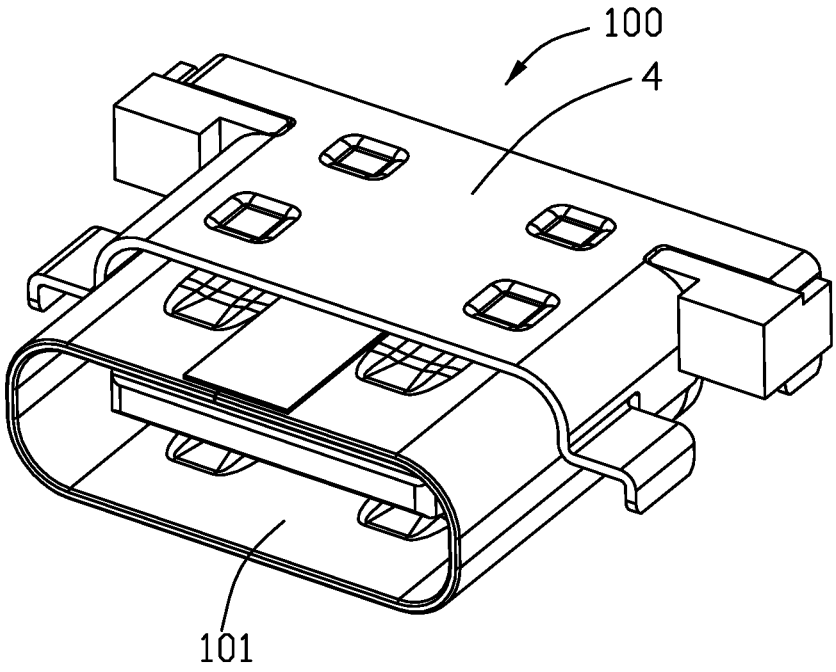
FIG. 1 is a perspective view of an electrical connector according to the present invention.
Figure 2:
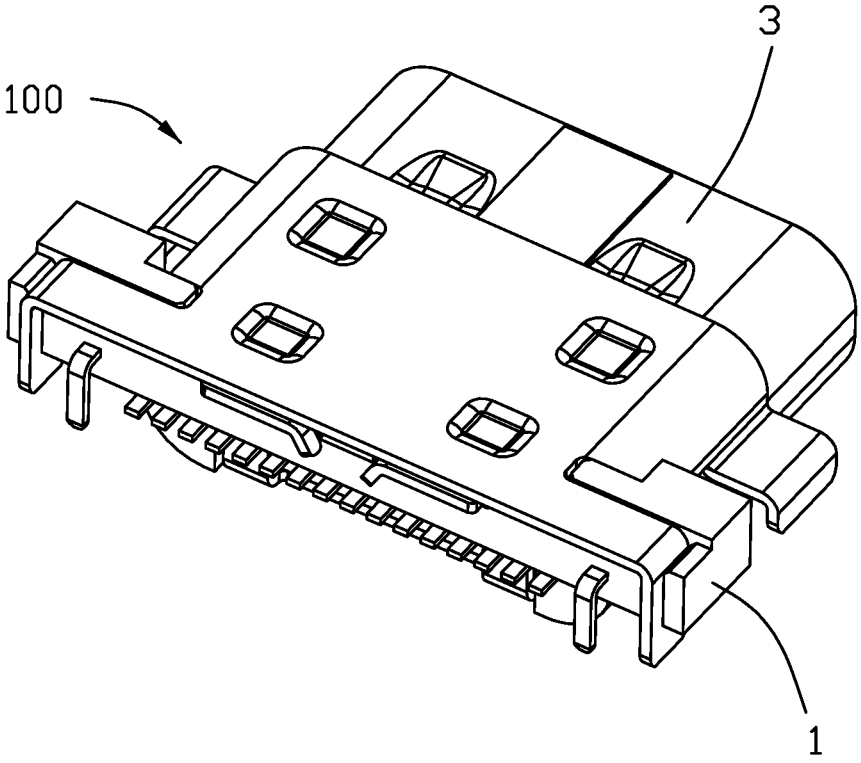
FIG. 2 is another perspective view of the electrical connector of FIG. 1.
Figure 3:
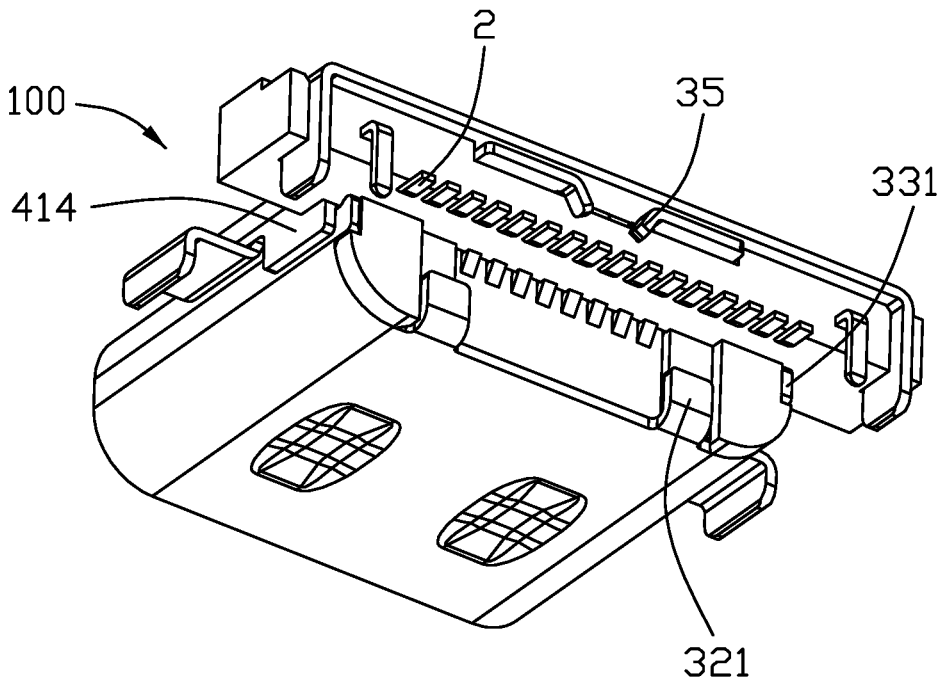
FIG. 3 is another perspective view of the electrical connector of FIG. 1.
Figure 4:
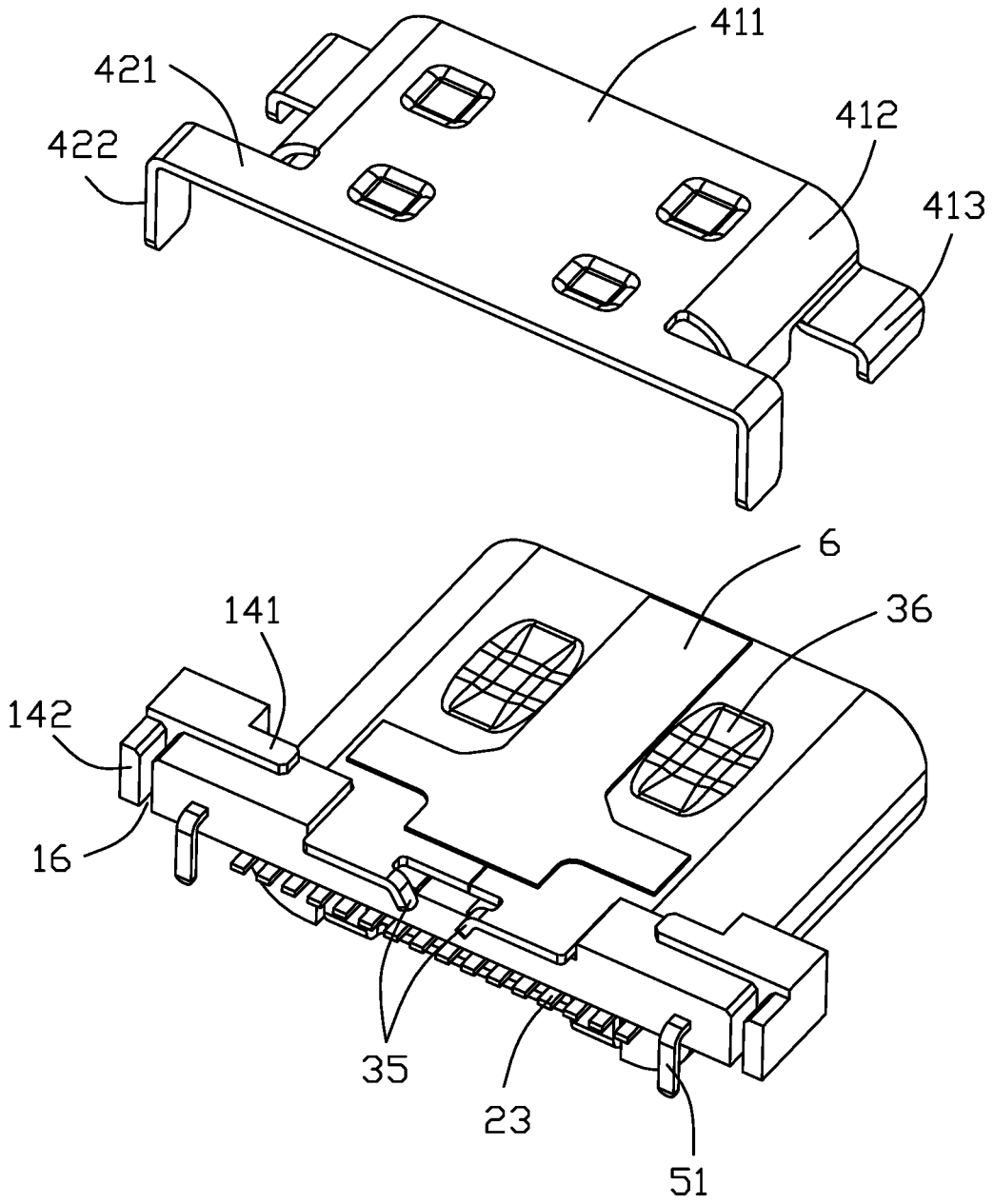
FIG. 4 is an exploded perspective view of the electrical connector of FIG. 1.
Figure 5:
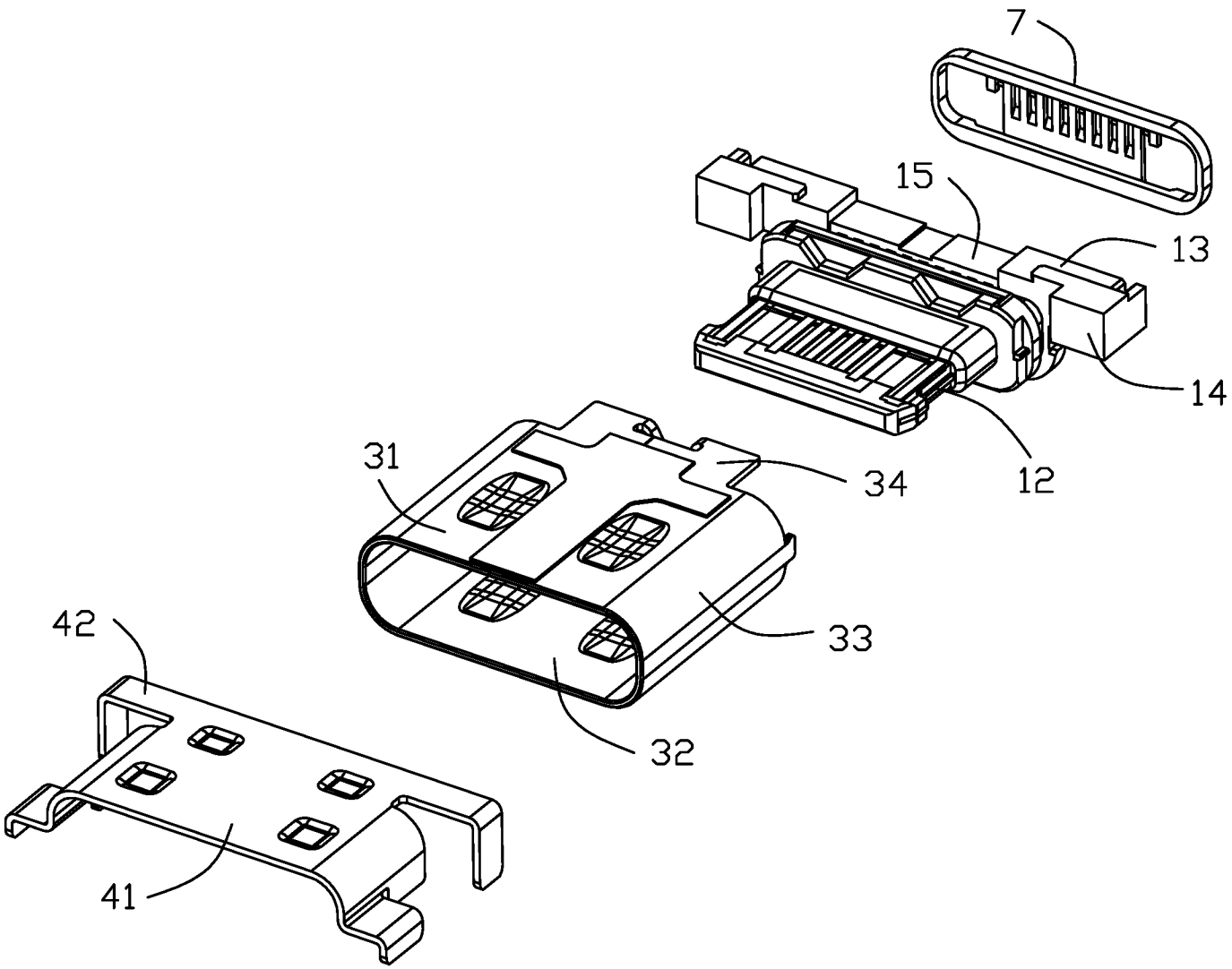
FIG. 5 is a further exploded perspective view of the electrical connector of FIG. 4.
Figure 6:
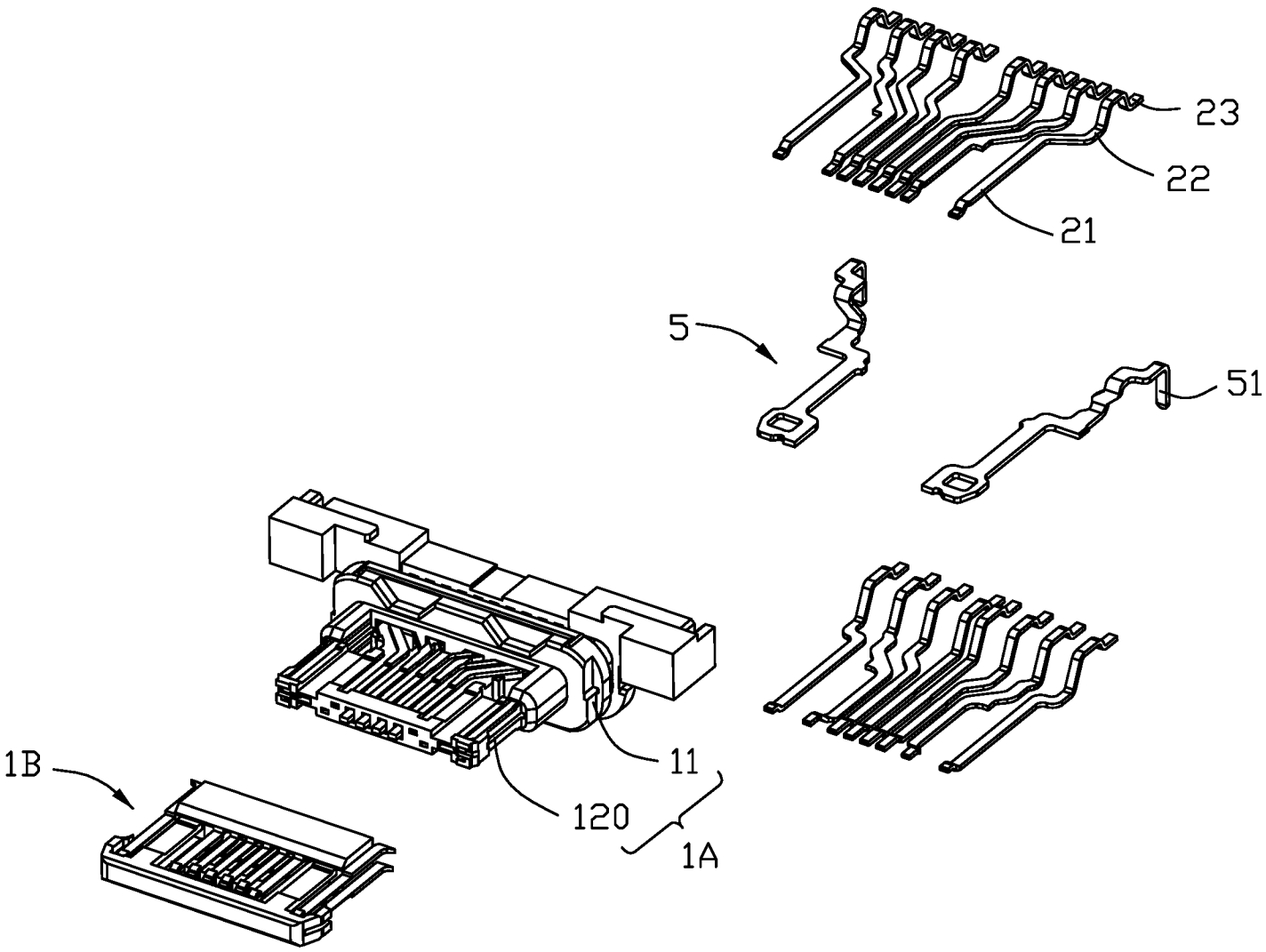
FIG. 6 is an exploded perspective view of the contact module of the electrical connector of FIG. 5.

Referring to FIG. 1-6, an electrical connector 100 includes an insulative housing 1, two rows of contacts 2 retained in the housing 1, a metallic inner shell 3 enclosing the insulative housing 1, and a metallic outer shell 4 secured upon the inner shell 3 so as to join together as a shell unit. The inner shell 3 forms a mating cavity 101.

Two rows of contacts 2 are spaced from each other with a pair of grounding pieces 5 therebetween in the vertical direction. The contacts 2 include the grounding contacts, the power contacts and the signal contacts. The contacts 2 and the grounding pieces 5 are commonly molded within an insulator 1A forming an inner tongue 120 extending from a base 11. An over-mold 1B further covers the inner tongue 120 to commonly form the complete mating tongue 12 which extends into the mating cavity 101. Understandably, the insulator 1A and the over-mold 1B commonly forms the housing 1. The grounding piece 5 includes a grounding leg 51 extending rearwardly out of the housing 1. Each contact 2 includes a contacting section 21 exposed upon the mating tongue 12, a retaining section 22 embedded within the insulator 1A, and a leg 23 extending outside of the housing 1. Notably, the contacts 2, the housing 1 and the grounding pieces 5 commonly form a contact module via at least one insert-molding process.

The housing 1 includes a fixing block 13 behind the base 11. The legs 23 extend through the fixing block 13 with corresponding ends under the fixing block 13. The grounding leg 51 of the grounding piece 5 extends rearwardly out of the fixing block 13. The fixing block 13 includes a pair of side wings 14 and a middle recess 15. The side wing 14 extends beyond a front plane of the main body of the fixing block 13. The side wing 14 includes a lateral extension 141 around the front face of the main body of the fixing block 13. A vertical plate 142 is located beside the main body of the fixing block 13 with a slot 16 therebetween in the transverse direction.

The inner shell 3 is assembled upon the housing 1 with the rear edge of the inner shell 3 abutting against the front face of the main body of fixing body 3. The inner shell 3 includes a top wall 31, a bottom wall 32 opposite to the top wall 31, and a pair of side walls 33 between the opposite top wall 31 and bottom wall 32. The inner shell 3 further includes a rearward extension 34 with a pair of securing tabs 35 abutting against a rear face of the fixing block 31. Understandably, the top wall 31 and the bottom wall 32 have the inward protrusions to be received within the recesses (not labeled) in a front face of the base 11 for abutment therebetween in the front-to-back direction. The top wall 31 and the bottom wall 32 further includes a plurality of embossments 36 for abutting against the mated plug connector (not shown) received within the mating cavity 101. A T-shaped sealing layer 36 is applied upon the top wall to cover the seam (not shown) of the inner shell 3.

The outer shell 4 includes a main body 41 and a pair of mounting legs 42 extending laterally from a rear portion of two lateral sides of the main body 41. The main body 41 includes a top cover 411 to be secured, via welding, upon the top wall 31, and a pair of side arms 412 extending from two lateral sides of the top cover 411 with corresponding mounting legs 413. The mounting leg 42 and the main body 42 are respectively located by opposite front and rear side of the extension 141 of the side wing 14. The mounting leg 42 includes a horizontal section 421 seated upon the fixing block 13, and a vertical section 422 extending downwardly from the horizontal section 421. The rear edge of the main body 41 abuts against a front face of the lateral extension 141, and the front edge of the horizontal section 421 abuts against a rear face of the lateral extension 141. The vertical section 422 extends through the slot 16 and is sandwiched between the vertical plate 1442 and the end wall of the fixing block 13 in the transverse direction.

The connector 100 further includes a glue plate 7 attached unto a rear side of the housing 1. The side wall 33 includes a securing leg 331 received within a recess (not labeled) in the base 11 under the fixing block 13. The bottom wall 32 includes a pair of securing lugs 321 abuts against the rear face of the base 11. Notably, via the securing tabs 35, the securing lugs 321 and the securing legs 331, the inner shell 3 is secured to the housing 1 in all directions. The side arms 412 of outer shell 4 include extensions 414 inwardly abutting, along the transverse direction, against the corresponding securing legs 331, respectively.

Compared with the prior arts, the connector 100 retains the mounting legs 42 of the outer shell 4 in position via the fixing block 13.

What is claimed is:

1. An electrical connector comprising:

a contact module including a plurality of contacts retained in an insulative housing, said housing including a base with a mating tongue extending forwardly from the base, and a fixing block on a rear side of the base;

a metallic inner shell enclosing the contact module; and a metallic outer shell secured upon a top side of the inner shell and including a pair of rear mounting legs; wherein the fixing block forms a pair of slots to snugly receive the pair of rear mounting legs therein, and the mounting legs extending beyond the bottom face of the fixing block; wherein the outer shell includes a top cover secured to the inner shell and a pair of side arms extending outwardly from opposite two sides of the top cover in a transverse direction, and the fixing block includes a pair of side wings to transversely protect rear portions of the corresponding side arms, respectively.

2. The electrical connector as claimed in claim 1, wherein rear edges of the pair of side arms abut rearwardly against the corresponding side wings in a front-to-back direction.

3. The electrical connector as claimed in claim 1, wherein the inner shell has a pair of side walls each equipped with a securing leg received within a recess in the base and being abutted against a corresponding extension of the corresponding side arm inwardly in said transverse direction.

4. The electrical connector as claimed in claim 1, wherein each mounting leg is restrained in the corresponding slot in a transverse direction and a forward direction.

5. The electrical connector as claimed in claim 1, wherein the fixing block is larger than the base in a transverse direction.

6. The electrical connector as claimed in claim 1, wherein the fixing block has a top recess not only receive a rearward extension of the inner shell but also horizontal sections of the pair of mounting legs.

7. The electrical connector as claimed in claim 1, wherein the inner shell includes a top wall with a pair of securing tabs forwardly abutting against a rear face of the base, and a bottom wall with a pair of securing lugs forwardly abutting against a rear face of the fixing block.

8. An electrical connector comprising:

an insulative housing including a base with a mating tongue forwardly extending therefrom, and a fixing block integrally formed on a rear upper side of the base;

a plurality of contacts integrally retained in the housing; and a metallic shell unit enclosing the housing to define a mating cavity, and including a pair of rear mounting legs each having a horizontal section and a vertical section; wherein the horizontal section is upwardly exposed to an exterior while the vertical section is received within a slot going through the fixing block in the vertical direction; wherein the shell unit includes an inner shell enclosing the housing and an outer shell on which the pair of rear mounting legs are unitarily formed; wherein the pair of mounting legs of the outer shell forwardly abut against the fixing block, and a pair of side arms of the outer shell rearwardly abut against the fixing block.

9. The electrical connector as claimed in claim 8, wherein the slot extends in a vertical plane along a front-to-back direction, and the pair of the mounting legs downward extend below a bottom face of the fixing block in an exposed manner.

10. The electrical connector as claimed in claim 8, wherein the inner shell includes a top wall with a pair of securing lugs forwardly abutting against a rear face of the base, and a bottom wall with a pair of securing tabs forwardly abutting against a rear face of the fixing block.

11. The electrical connector as claimed in claim 8, wherein the fixing block is dimensioned larger than the base in a transverse direction, and includes a pair of side wings in which the pair of slots are formed and against which the side arms of the outer shell abut rearwardly.

12. The electrical connector as claimed in claim 11, wherein the base forms a pair of recesses under the pair of side wings, respectively, and the inner shell forms a pair of securing legs received within the corresponding recesses, respectively.

13. The electrical connector as claimed in claim 12, wherein the securing legs inwardly abut against the corresponding side arms, respectively, in said transverse direction.

14. An electrical connector comprising:

a contact module including a plurality of contacts retained in an insulative housing, said housing including a base with a mating tongue extending forwardly from the base, and a fixing block on a rear side of base;

a metallic inner shell enclosing the contact module; and a metallic outer shell secured upon a top side of the inner shell and including a pair of rear mounting legs; wherein the fixing block forms a pair of slots to snugly receive the pair of rear mounting legs therein; wherein the outer shell includes a top cover secured to the inner shell and a pair of side arms extending outwardly from opposite two sides of the top cover in a transverse direction, and the fixing block includes a pair of side wings to transversely protect rear portions of the corresponding side arms, respectively.

15. The electrical connector as claim in claim 14, wherein rear edges of the pair of side arms abut rearwardly against the corresponding side wings in a front-to-back direction.

16. The electrical connector as claim in claim 14, wherein the inner shell has a pair of side walls each equipped with a securing leg received within a recess in the base and being abutted against a corresponding extension of the corresponding side arm inwardly in said transverse direction.

* * * * *